United States Patent [19]

Jackson et al.

[11] Patent Number: 5,035,958

[45] Date of Patent: Jul. 30, 1991

[54] NICKEL-BASE SUPERALLOYS ESPECIALLY USEFUL AS COMPATIBLE PROTECTIVE ENVIRONMENTAL COATINGS FOR ADVANCED SUPERALOYS

[75] Inventors: Melvin R. Jackson, Schenectady, N.Y.; Mark L. Prugar, Mason, Ohio; Swe-Wong Yang, Clifton Park, N.Y.; John R. Rairden, III, Schenectady; Michael F. X. Gigliotti, Jr., Scotia, both of N.Y.

[73] Assignee: General Electric Company, Cincinnati, Ohio

[21] Appl. No.: 420,708

[22] Filed: Oct. 11, 1989

Related U.S. Application Data

[63] Continuation of Ser. No. 314,233, Feb. 21, 1989, abandoned, is a continuation of Ser. No. 195,444, May 12, 1988, abandoned, which is a continuation of Ser. No. 59,179, Jun. 12, 1987, abandoned, which is a continuation of Ser. No. 890,966, Jul. 29, 1986, abandoned, which is a continuation of Ser. No. 768,929, Aug. 26, 1985, abandoned, which is a continuation of Ser. No. 565,802, Dec. 27, 1983, abandoned.

[51] Int. Cl.[5] ..... B22F 7/04

[52] U.S. Cl. ..... 428/553; 428/614; 428/678; 420/443; 420/445; 420/448

[58] Field of Search ..... 420/443, 445, 448, 553; 428/414, 478

[56] References Cited

U.S. PATENT DOCUMENTS

| | | | |
|---|---|---|---|
| 3,276,865 | 10/1966 | Fredie et al. | 420/439 |
| 3,526,499 | 9/1970 | Quigg et al. | 420/448 |
| 3,904,402 | 9/1975 | Smashey | 420/439 |
| 3,928,026 | 12/1975 | Hecht et al. | 428/615 |
| 4,054,723 | 10/1977 | Higginbottam et al. | 428/678 |
| 4,116,723 | 9/1978 | Gell et al. | 148/162 |
| 4,169,742 | 10/1979 | Wukusick et al. | 148/404 |
| 4,209,348 | 6/1980 | Duhl et al. | 420/448 |
| 4,222,794 | 9/1980 | Schweizer | 148/162 |
| 4,284,430 | 8/1981 | Henry | 420/443 |
| 4,288,247 | 9/1981 | Shaw | 420/443 |
| 4,292,076 | 9/1981 | Gigliotti et al. | 420/448 |
| 4,313,760 | 2/1982 | Dardi et al. | 428/678 |
| 4,326,011 | 4/1982 | Goebel et al. | 428/678 |

*Primary Examiner*—Stephen J. Lechert, Jr.
*Attorney, Agent, or Firm*—Stephen S. Strunck; Carmen Santa Maria; Jerome C. Squillaro

[57] ABSTRACT

There is provided by the present invention an alloy which is mechanically and chemically compatible with advanced nickel-base superalloys and nickel-base eutectic superalloys and which possesses excellent resistance to high temperature oxidation. The alloy of the invention is, therefore, particularly useful as a protective environmental coating for the external surfaces of hot-stage aircraft gas turbine engine components, e.g., rotating blades and stationary vanes, made from such advanced superalloys.

18 Claims, 4 Drawing Sheets

NICKEL-BASE SUPERALLOYS ESPECIALLY USEFUL AS COMPATIBLE PROTECTIVE ENVIRONMENTAL COATINGS FOR ADVANCED SUPERALOYS

The Government has rights in this invention pursuant to Contract No. F33615-77-C-5200 awarded by the United States Department of the Air Force.

This is a continuation of application Ser. No. 07/314,233 filed Feb. 21, 1989 which is a continuation of application Ser. No. 195,444, filed May 12, 1988, now abandoned, which is a continuation of application Ser. No. 059,179 filed Jun. 12, 1987, now abandoned, which is a continuation of application Ser. No. 890,966 filed July 29, 1986, now abandoned, which is a continuation of application Ser. No. 768,929 filed Aug. 26, 1985, now abandoned, which is a continuation of application Ser. No. 565,802 filed Dec. 27, 1983, now abandoned.

CROSS-REFERENCE TO RELATED APPLICATION

The invention disclosed and claimed herein is related to the invention disclosed and claimed in patent application Ser. No. 06/565,803, filed of even date herewith.

BACKGROUND OF THE INVENTION

This invention pertains generally to nickel-base superalloys useful in the manufacture of hot-section components of aircraft gas turbine engines, e.g., vanes and rotating blades, and more particularly to compatible coatings especially useful for the enhancement of the environmental resistance of such hot-section components made from advanced nickel-base superalloys and nickel-base eutectic superalloys.

Advanced nickel-base superalloys such as the monocarbide reinforced nickel-base eutectic superalloys of the type described, for example, in U.S. Pat. No. 4,292,076 to Gigliotti, Jr. et al., which is incorporated herein by reference, are designed for use as unidirectionally solidified anisotropic metallic bodies, primarily in the form of vanes and rotating blades in aircraft gas turbine engines. The superalloys of U.S. Pat. No. 4,292,076, when directionally solidified (DS'd) under stringent conditions to achieve planar front solidification (PFS), result in a eutectic composite microstructure consisting of strong, reinforcing metallic carbide (MC) fibers in a $\gamma/\gamma'$ nickel-base superalloy matrix. Because highly aligned microstructures are formed during planar front solidification, the superalloys of U.S. Pat. No. 4,292,076 offer potential structural stability and property retention to a greater fraction of their solidification temperatures than do other materials.

The eutectic superalloys have been identified as the next generation of blade alloys beyond directionally solidified and single crystal superalloys. In order to take full temperature advantage of those superalloys, however, coatings are required to provide environmental protection at the high intended use temperatures.

Stringent requirements are placed on the coatings and the coating/substrate composite. For example, the coatings must be tightly bonded, i.e., metallurgically bonded, to the substrate and ideally must not degrade either the mechanical properties of the substrate (e.g., ductility, stress rupture strength and resistance to thermal fatigue) or the chemical properties of the substrate (e.g., oxidation resistance and hot corrosion resistance).

Examples of adverse effects to eutectic superalloys which have resulted from incompatible coatings are fiber denudation near the coating/substrate interface due to outward diffusion of carbon from the fiber into the coating and the formation of brittle precipitates in the substrate due to interdiffusion between the coating and the substrate.

While many coatings and barrier/coating systems have been proposed and tried, there has been a general inability in the past to specify coatings or barrier/coating system which are truly compatible with the substrate, i.e., offer improved environmental protection and produce good metallurgical bonds with the substrate yet not degrade the mechanical or chemical propertied of the substrate, especially when the substrate is of an alloy of the type described in U.S. Pat. No. 4,292,076.

Therefore, there exists a need for protective environmental coatings which are truly compatible with the newest generation of superalloys, particularly those designed for use as vanes and rotating blades in aircraft gas turbine engines, such as the directionally solidified monocarbide reinforced nickel-base eutectic superalloys of the type described in U.S. Pat. No. 4,292,076.

SUMMARY OF THE INVENTION

There is provided by the present invention a nickel-base superalloy which is mechanically and chemically compatible with advanced nickel-base superalloys and nickel-base eutectic superalloys, and which possesses excellent resistance to high temperature oxidation. The alloy of the invention is, therefore, particularly useful as a protective environmental coating for the external surfaces of hot stage aircraft gas turbine engine components, e.g., rotating blades and stationary vanes, made from advanced nickel-base superalloys and nickel-base eutectic superalloys.

Broadly, the superalloy of the invention consists essentially of about, by weight, 1 to 10% cobalt, 6 to 12% chromium, 5 to 8% aluminum, 1 to 10% tantalum, 1 to 10% tungsten, 0 to 3% rhenium, 0 to 2% molybdenum, 0.1 to 2% hafnium, 0.005 to 0.1% boron, 0.005 to 0.25% carbon, the balance being nickel and incidental impurities.

While it is contemplated that the above-described novel superalloy will be applied most frequently as a protective environmental coating to comprise at least a portion of the outer surface of gas turbine engine components and articles, it has also been found that the novel alloy of this invention is useful as a thicker, built-up deposit applied to selected regions of substrates, such as aircraft gas turbine engine components, for repair purposes, or as the tip portion of rotating blades. Such applications then, contemplate composite articles of manufacture having as a substrate an article, such as a gas turbine engine airfoil, made of a nickel-base superalloy or nickel-base eutectic superalloy and one or more thick, built-up regions contiguous with, i.e., joined to and forming an integral part of, the substrate wherein the one or more regions comprise at least a portion of the outer surface of the composite article and are of the above-described novel superalloy composition.

DESCRIPTION OF THE PREFERRED EMBODIMENT

Figure 1:
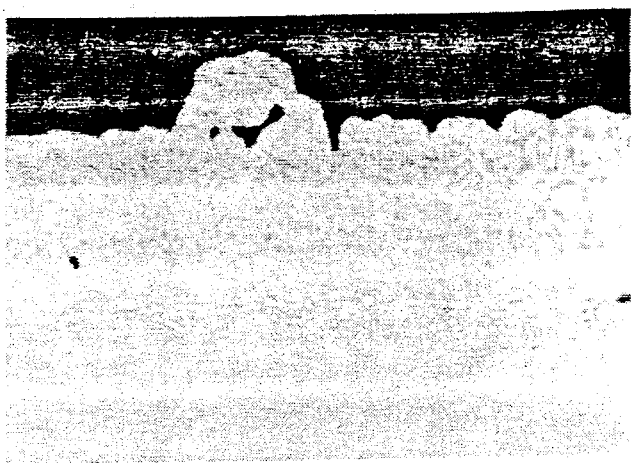
FIG. 1 is a photomicrograph at 200× of a NiCoCrAlY type coating as-deposited on a B-type nickel-base eutectic superalloy substrate.

As set forth in the foregoing summary, the present invention relates to a nickel-base superalloy which is mechanically and chemically compatible with advanced nickel-base superalloys and nickel-base eutectic superalloys and which possesses excellent resistance to high temperature oxidation. The superalloy of the invention consists essentially of cobalt, chromium, aluminum, tantalum, tungsten, rhenium, molybdenum, hafnium, boron and carbon in the percentages (by weight) set forth in Table I below, the balance being nickel and incidental impurities.

TABLE 1

| | ALLOY COMPOSITIONS (weight %) | | |
|---|---|---|---|
| Elements | Base | Preferred | More Preferred |
| Co | 1-10% | 1-6% | 3.8-4.2% |
| Cr | 6-12% | 7-10% | 8.3-8.7% |
| Al | 5-8% | 5-7% | 5.8-6.2% |
| Ta | 1-10% | 4-6% | 4.7-5.3% |
| W | 1-10% | 3.5-5.5% | 4.2-4.8% |
| Re | 0-3% | 0-3% | 1.2-1.8% |
| Mo | 0-2% | 0-2% | 1.3-1.7% |
| Hf | 0.1-2% | 0.5-1.5% | 0.7-1.1% |
| B | 0.005-0.1% | 0.005-0.025% | 0.005-0.02% |
| C | 0.005-0.25% | 0.005-0.25% | 0.005-0.2% |

The present alloy is particularly useful as a protective environmental coating, of between about 0.002 and 0.1 inches in thickness, for the external surfaces of solid and hollow, fluid-cooled gas turbine engine components, e.g., rotating blades and stationary vanes, operating in the hot stage sections of such turbines and made from advanced nickel-base superalloys and nickel-base eutectic superalloys. While it is contemplated that the novel alloy herein described will most frequently be applied as protective environmental coatings to provide at least a portion of the outer surface of gas turbine engine components and articles, it has also been found that the superalloy of the invention is also useful as one or more thicker, built-up deposits applied to selected regions of such articles or component-like substrates.

Whether the novel alloy is deposited as coating or thicker, built-up deposits, the utilization of plasma spray techniques to deposit the alloy of the invention is preferred. Most preferred is the technique, sometimes referred to as low pressure plasma deposition (LPPD), described in U.S. Pat. No. 3,839,618—Muehlberger, which patent is incorporated herein by reference. Alloys in accordance with the present invention produce very dense coatings or deposits after plasma spraying and especially after plasma spraying by the above-mentioned LPPD process whereby as-deposited densities of 95% and greater are readily obtained.

The wide differences in the evaporation rates (or vapor pressures) between high vapor pressure elements like chromium, manganese or aluminum and low vapor pressure elements like tantalum or tungsten make the deposition and composition control of coatings of the novel alloy of this invention by other processes such as vacuum physical vapor deposition difficult, if not impossible. It will be appreciated, however, that process improvements or modifications in methods such as physical vapor deposition or ion plating could make coating by these methods possible, and the use of these methods is therefore contemplated. Additionally, techniques like sputtering, slurry sintering, or others may also be considered.

To illustrate the practice of the present invention, a series of coatings, hereinafter referred to as the "6M" or 6M-type coatings by way of designation, were produced by low pressure plasma deposition of an alloy of the invention, i.e., one consisting essentially of, nominally by weight within normal melting tolerances, 4% Co, 8.5% Cr, 6% Al, 5% Ta, 4.5% W, 1.5% Re, 1.5% Mo, 0.9% Hf, 0.01% B, and 0.09% C, with balance nickel and incidental impurities, onto flat plate-like substrates and pin-like substrates for environmental testing.

A nickel-base superalloy conforming to U.S. Pat. No. 4,292,076, i.e., one consisting essentially of about, on a weight basis, at least an amount in excess of an impurity amount up to 0.02% of B, 0 to 9% Re, 0 to <0.8% Ti, 0 to 20% Cr, 0 to 10% Al, 3 to 15% Ta, 0.1 to 1% C, 0 to 20% Co, 0 to 20% W, 0 to 7% V, 0 to 10% Mo, 0 to 3% Cb, 0 to 3% Hf, 0 to 1.5% Zr, the balance being nickel and incidental impurities, but having a nominal composition of about, by weight, 0.01% B, 6.44% Re, 3.84% Cr, 5.34% Al, 11.37% Ta, 0.43% C, 3.8% Co, 4.33% W, 3.01% Mo, balance nickel and incidental impurities, and hereinafter referred to as the "B" or B-type substrate for purposes of designation, was provided as one substrate.

A nickel-base superalloy capable of being cast as a single crystal by directional solidification and conforming to that described in copending, co-assigned patent application Ser. No. 307,819, filed Oct. 2, 1981, i.e., consisting essentially of, by weight, 7 to 12% Cr, 1 to 5% Mo, 3 to 5% Ti, 3 to 5% Al, 5 to 15% Co, 3 to 12% W, 2 to 6% Ta, up to 10% Re, up to 2% Cb, up to 3% V, up to 2% Hf, balance nickel and incidental impurities, further characterized by the substantial absence of C, B, and Zr and wherein the Al:Ti ratio is maintained in the range of about 0.5 to about 1 while maintaining the Cr:Al ratio in the range of about 1.5 to 4 was provided as a second substrate and is hereinafter referred to as the "N" or N-type substrate for purposes of designation. More specifically, the composition of the second substrate material was, nominally, by weight, 9.3% Cr, 7.5% Co, 3.7% Al, 4% Ta, 4.2% Ti, 1.5% Mo, 6% W, 0.5% Nb, the balance nickel plus incidental impurities.

For comparison, separate substrates of the above-described B-type and N-type were also provided with a coating typically used heretofore to enhance the resistance of such substrates to environmental degradation. In this case, the coating material selected was a NiCoCrAlY (Ni-23Co-18Cr-12.5Al-0.3Y) of the type described in U.S. Pat. No. 3,928,026, which patent is herein incorporated by reference. All coatings of the NiCoCrAlY type were deposited by a commercial vendor using the physical vapor deposition (PVD) process described in the aforementioned U.S. Pat. No. 3,928,026 patent.

Prior to coating deposition, the B-type substrates were solution treated at 2325° F. for two hours and the N-type substrates were solution treated at 2310° F. for two hours irrespective of the coating to be applied. The process of applying the NiCoCrAlY type coatings has been described above. The 6M coatings were applied by the above-described LPPD plasma spray process. For the B-type substrates, a commercially available standard internal feed plasma spray gun and the process parameters of Table II were used. For the N-type substrates, a commercially available standard external feed plasma spray gun and the process parameters of Table III were used.

TABLE II

| LPPD PLASMA SPRAY PROCESS PARAMETERS (6M COATINGS ON B-TYPE SUBSTRATES) | |
|---|---|
| Gun-to-Substrate Distance | 14–16 inches |
| Voltage | 50 volts nominal |
| Current | 1350 amps nominal |
| Primary Gas/Rate | Argon/175–180 std. l./min. |
| Secondary Gas/Rate | Helium/35–50 std. l./min. |
| Carrier Gas/Rate | Argon/15 std. l./min. |
| Powder Feed Rate | 25–30 lbs./hr. |
| Powder Size | −400 mesh (37μ) nominal |
| Chamber Pressure | 60 torr nominal |

TABLE III

| LPPD PLASMA SPRAY PROCESS PARAMETERS (6M COATINGS ON N-TYPE SUBSTRATES) | |
|---|---|
| Gun-to-Substrate Distance | 12–15 inches |
| Voltage | 50 volts nominal |
| Current | 800 amps nominal |
| Primary Gas/Rate | Argon/50 std. l./min. |
| Secondary Gas/Rate | Hydrogen/6 std. l./min. |
| Carrier Gas/Rate | Argon/1 std. l./min. |
| Powder Feed Rate | 10 lbs./hr. |
| Powder Size | −400 mesh (37μ) nominal |
| Chamber Pressure | 30–40 torr |

To optimize the properties of the substrates, all coated substrates were subjected to a post-deposition heat treatment which typically consisted of a first age at 1975° F. for 2–8 hours followed by a second age at 1650° F. for 4–16 hours. At this stage, the coatings are referred to as "as-deposited" coatings. The structure of the B-type substrate is one of an aligned eutectic (TaC) fibrous reinforcing phase in a $\gamma/\gamma'$ matrix while the structure of the N-type substrate is one of $\gamma'$ precipitates in a $\gamma$ matrix.

Table IV presents the results of cyclic oxidation tests on pin-like specimens conducted under the conditions shown in the table using a natural gas flame at the velocities shown in the table. The specimens were rotated for uniform exposure and cycled out of the flame 1 or 6 times per hour to cool the specimens to about 800° F. Failure is defined as penetration of the coating to the extent that (substrate) oxidation begins to occur. Hot corrosion testing was conducted at 1700° F. using a JP-5 fuel-fired flame with 5 ppm salt added to the combustion products. The specimens were rotated for uniform exposure and cycled out of the flame once every hour.

It may be seen from Table IV that the alloy of the invention as a coating provides good protection to both substrates, and particularly to the B-type substrate. The oxidation resistance provided by the alloy of the invention is somewhat greater than would be expected based on a study of its overall composition. These unexpected properties are attributed to the absence of titanium and the presence of hafnium in combination with the slightly higher-than-usual aluminum content (6%) and a proper balance of carbon and the other refractory elements. This balance of elements helps form and maintain a protective alumina scale when exposed in air. Although having lower resistance to hot corrosion than NiCoCrAlY, the alloy of the invention as a coating provides acceptable environmental protection against hot corrosion, i.e., greater than 540 hours life on B-type substrates (test terminated prior to failure) and 10000 hours on N-type substrates.

TABLE IV

| CYCLIC OXIDATION TESTS | | | |
|---|---|---|---|
| TEST CONDITIONS | SUB-STRATE TYPE | COATING | TIME TO FAILURE (hrs) |
| 2200° F., Mach 1 Gas Velocity, Cycled to 800° F. once/hr | B | 6M | Test terminated after 300 hrs.-no failures |
| 2100° F., Mach 0.05 | B | NiCoCrAlY | 500 |
| Gas Velocity, Cycled to 800° F. 6×/hr. | B | 6M | 500 |
| 2075° F., Mach 1 | N | NiCoCrAlY | 500 |
| Gas Velocity, Cycled to 800° F. once/hr. | N | 6M | 325 |

The coated specimens were evaluated metallographically to determine the extent of interaction between the coatings and the substrate. The results are given in Table V which lists the extent, if any, of the denuded and platelet formation zones, the sum of which comprise the interaction zone, following exposure in the oxidation tests at the temperatures and for the times shown.

TABLE V

| AVERAGE DEPTH OF INTERACTION ZONE FOLLOWING OXIDATION TESTING | | | | |
|---|---|---|---|---|
| COATING/ SUBSTRATE | EX-POSURE (hrs./°F.) | DENUDED (mils) | PLATE-LET (mils) | TOTAL (mils) |
| NiCoCrAlY/B | 500/2100 | 6.0 | 5.0 | 11.0 |
| 6M/B | 500/2100 | 2.4 | 1.4 | 3.8 |
| NiCoCrAlY/N | 400/2075 | 1.3 | 2.7 | 4.0 |
| 6M/N | 550/2075 | 0.9 | 0 | 0.9 |

Figure 3:
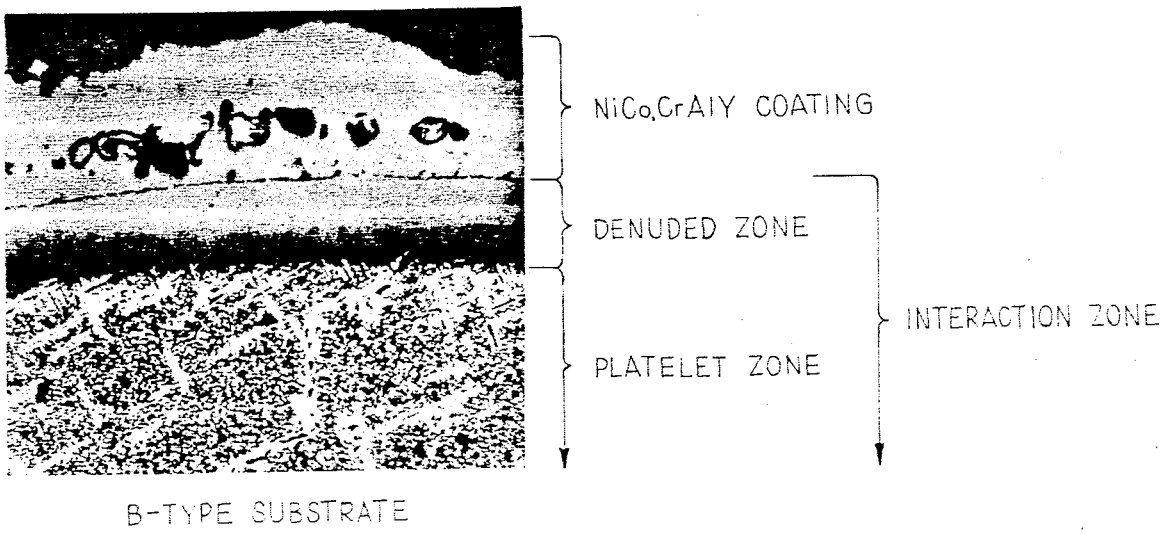
FIG. 3 is a photomicrograph at 200× of a NiCoCrAlY type coating on a B-type substrate following exposure of 500 at 2100° F. in a Mach 0.05 gas velocity oxidation test, in which the specimens were cycled to 800° F. six times per hour.
Figure 7:
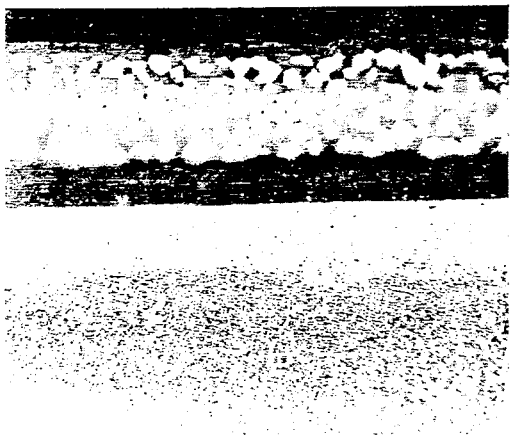
FIG. 7 is a photomicrograph at 200× of a NiCoCrAlY type coating on an N-type substrate following exposure of 400 hours at 2075° F. in a Mach 0.05 gas velocity oxidation test, in which the specimens were cycled to 800° F. six times per hour.

Platelets such as those shown in FIGS. 3 and 7 for NiCoCrAlY on the B and N-type substrates, respectively, are a result of the interdiffusion of elements between the coating and the substrate, i.e., a chemical incompatibility between the coating and the substrate. The platelets are undesirable due to their needle-like morphology and brittleness. The denuded zone, also shown in FIGS. 3 and 7, is a zone which has been depleted of $\gamma'$ due to the diffusion of elements from the substrate to the coating, leaving a weakened, primarily $\gamma$matrix.

Figure 2:
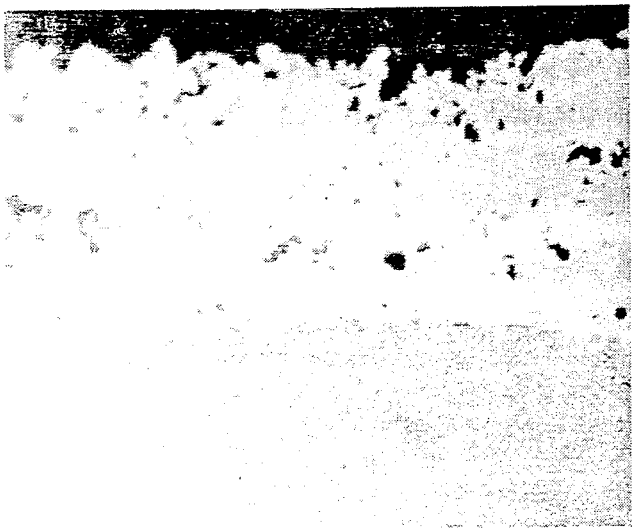
FIG. 2 is a photomicrograph at 250× of the alloy of the invention as-deposited as a coating on a B-type substrate by the low pressure plasma deposition (LPPD) process.
Figure 5:
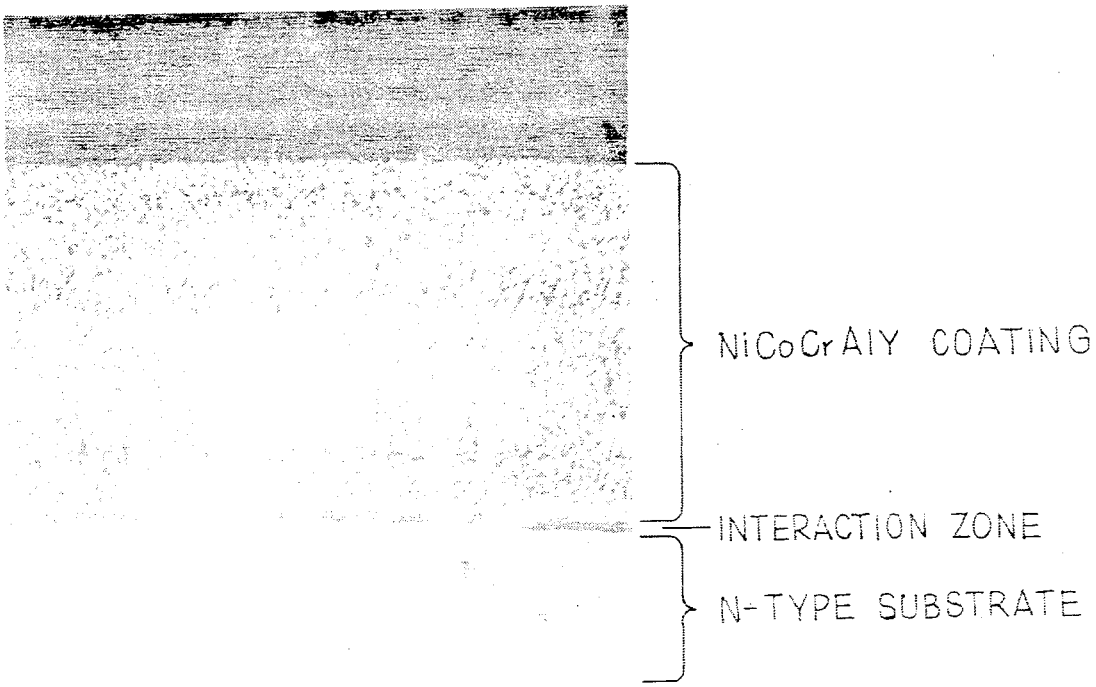
FIG. 5 is a photomicrograph at 500× of a NiCoCrAlY type coating as-deposited on an N-type nickel-base single crystal superalloy substrate.
Figure 6:
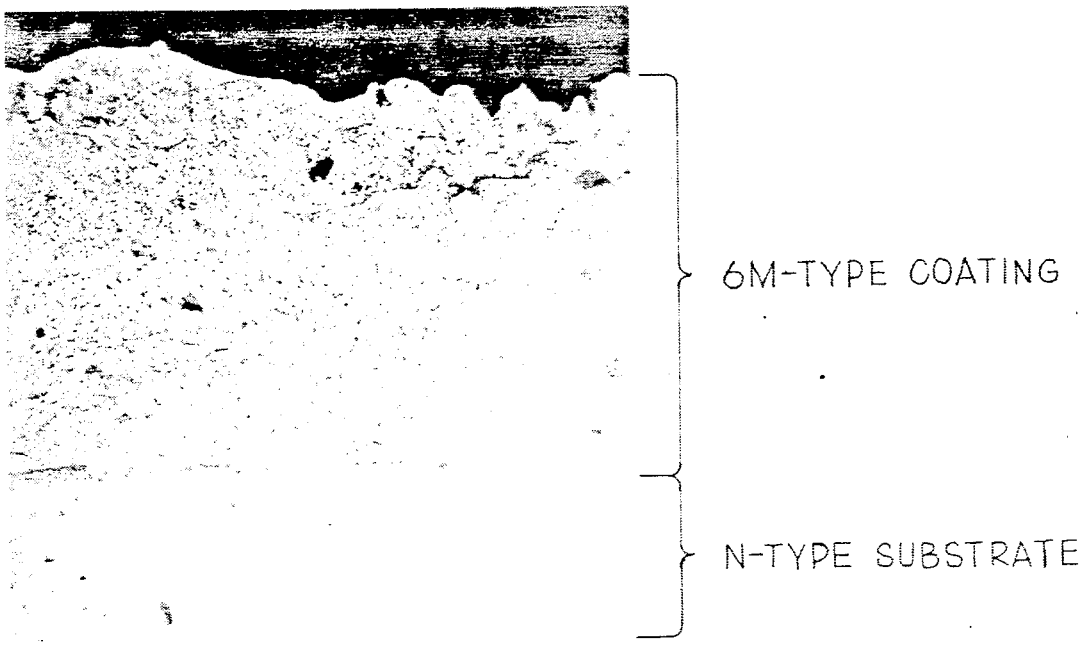
FIG. 6 is a photomicrograph at 500× of the alloy of the invention as-deposited as a coating on an N-type substrate by the LPPD process.

Reference to FIGS. 2 and 6 show that in the as-deposited condition there is virtually no interaction zone formed between the 6M coating and either the B-type or N-type substrates. A slight interaction zone, however, is evident in FIGS. 1 and 5 between the NiCoCrAlY coating and both the B-type and N-type substrates.

Figure 4:
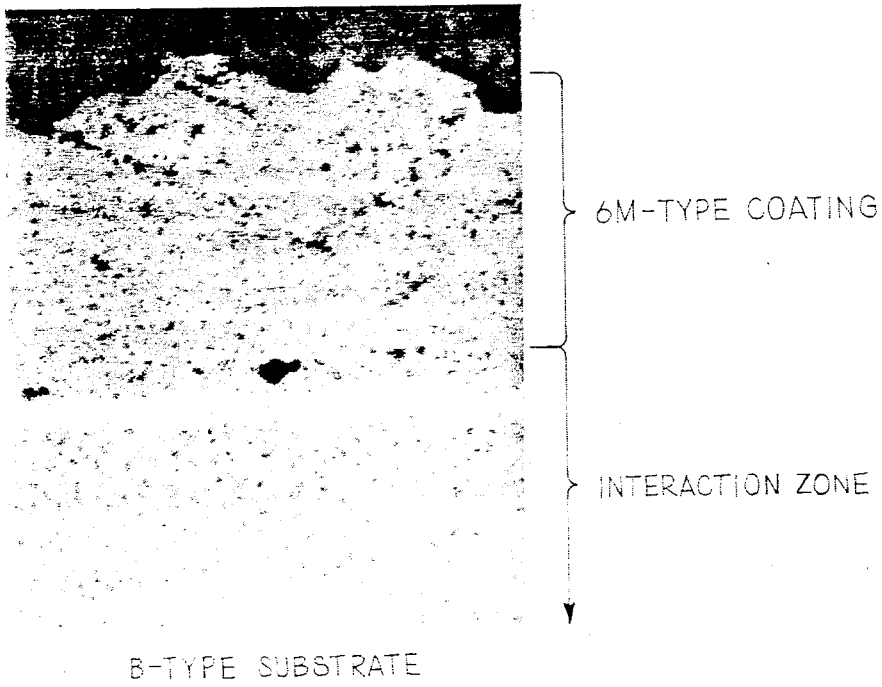
FIG. 4 is a photomicrograph at 500× of the alloy of the invention on a B-type substrate after exposure of 500 hours in the same oxidation test described above for FIG. 3.

Reference to FIGS. 3 and 4, and Table V, shows that after 500 hours exposure at 2100° F. in the oxidation test an interaction zone has formed between the NiCoCrAlY coating and the B-type substrate which is about three times deeper than the interaction zone formed between the 6M coating and the B-type substrate. Further, about 45% of the interaction zone in the NiCoCrAlY/B pair is of the deleterious platelet phase.

Figure 8:
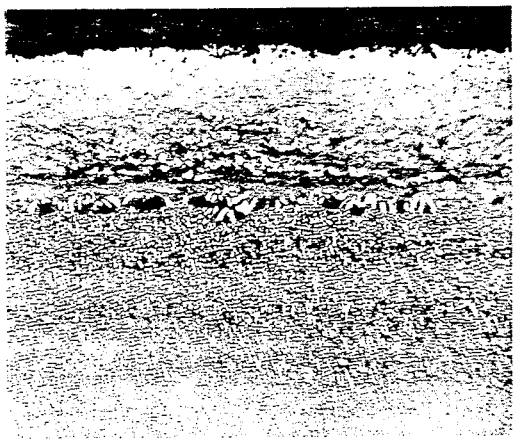
FIG. 8 is a photomicrograph at 200× of the alloy of the invention on an N-type substrate following exposure of 550 hours at 2075° F. in the same oxidation test described above for FIG. 7.

Similarly, reference to FIGS. 7 and 8, and Table V, shows that after 400 hours exposure at 2075° F. in the oxidation test an interaction zone has formed between the NiCoCrAlY coating and the N-type substrate which is deeper than about four times the interaction zone formed between the 6M coating and the N-type substrate, even though the 6M/N pair was tested for about a 40% longer period of time. About 70% of the interaction zone in the NiCoCrAlY/N pair is of the deleterious platelet phase.

In addition to the unique combination of reduced diffusional interaction and good environmental resistance, the alloy of the invention also possesses high temperature strength superior to NiCoCrAlY. Elevated temperature tensile tests on very thick ($\sim\frac{1}{2}$ inch) deposits of the NiCoCrAlY and 6M-type alloys showed that at 1800° F. the ultimate tensile strength (UTS) of the materials was about 7 and 30 ksi, respectively, while at 2000° F. the UTS of the materials was about 3 and 7, respectively. The higher strength of the 6M-type alloy is expected to result in greatly improved resistance to thermal/mechanical fatigue cracking.

Since the alloy of the invention is itself a superalloy, the difference in the coefficient of thermal expansion ($\alpha$) between the alloy of the invention and nickel-base superalloy substrates is less than that between NiCoCrAlY and the same superalloy substrates. The smaller difference in $\alpha$ reduces the stresses imposed on a coating alloy in service, and thereby reduces the propensity for coating spallation and thermal fatigue cracking.

Thus, the low propensity of the alloy of the invention to form interaction zones, and particularly its low propensity to form platelets, plus its higher strength and thermal expansion compatibility with superalloy substrates makes the alloy of the invention a coating which is truly chemically and physically compatible with nickel-base superalloy substrates, in addition to providing the environmental resistance required in severe high pressure, high temperature turbine environments.

It has also been found that the novel alloys of this invention are useful as thicker, built-up deposits applied to selected regions of aircraft gas turbine engine components, such as the tip portions of rotating blades or stationary vanes, or for purposes of repairing nicked or damaged regions as typically occur on such components as airfoils. In that respect, the alloys of the invention are more in the nature of a superalloy from which components are made, e.g., structural or weight-carrying alloys, and less in the nature of coatings. The changes required in the plasma spraying process to effect the build-up of thicker deposits, as opposed to thin coatings, are well within the knowledge and expertise of those ordinarily skilled in the plasma spraying arts.

It will be understood that various changes and modifications not specifically referred to herein may be made in the invention herein described, and to its uses herein described, without departing from the spirit of the invention particularly as defined in the following claims.

What is desired to be secured by Letters Patent of the United States is the following.

We claim:

1. A composition for application to nickel-base superalloy substrates consisting essentially of, by weight, 1 to 10% cobalt, 6 to 12% chromium, 5 to 8% aluminum, 1 to 10% tantalum, 1 to 10% tungsten, 0 to 3% rhenium, 0 to 2% molybdenum, 0.1 to 2% hafnium, 0.005 to 0.1% boron, 0.005 to 0.25% carbon, the balance nickel and incidental impurities.

2. The composition of claim 1 consisting essentially of, by weight, 1 to 6% cobalt, 7 to 10% chromium, 5 to 7% aluminum, 4 to 6% tantalum, 3.5 to 5.5% tungsten, 0 to 3% rhenium, 0 to 2% molybdenum, 0.5 to 1.5% hafnium, 0.005 to 0.025% boron, 0.005 to 0.025% carbon, the balance nickel and incidental impurities.

3. The composition of claim 2 consisting essentially of, weight, 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.02% carbon, the balance nickel and incidental impurities.

4. A high temperature oxidation and corrosion resistant coated nickel-base superalloy article characterized by high coating-substrate compatibility, said article comprising:

(a) a nickel-base superalloy or nickel-base eutictic superalloy substrate, and (b) a coating providing at least a portion of the outer surface of said article, said coating consisting essentially of, by weight, 1 to 10% cobalt, 6 to 12% chromium, 5 to 8% aluminum, 1 to 10% tantalum, 1 to 10% tungsten, 0 to 3% rhenium, 0 to 2% molybdenum, 0.1 to 2% hafnium, 0.005 to 0.1% boron, 0.005 to 0.25% carbon, the balance nickel and incidental impurities.

5. The article of claim 4 wherein said coating consists essentially of, by weight, 1 to 6% cobalt, 7 to 10% chromium, 5 to 7% aluminum, 4 to 6% tantalum, 3.5 to 5.5% tungsten, 0 to 5% rhenium, 0 to 2% molybdenum, 0.5 to 1.5% hafnium, 0.005 to 0.025% boron, 0.005 to 0.25% carbon, the balance nickel and incidental impurities.

6. The article of claim 5 wherein said coating consists essentially of, by weight, 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.2% carbon, the balance nickel and incidental impurities.

7. The article of claim 4 wherein said substrate comprises a composite of a nickel-base superalloy matrix and an aligned fibrous monocarbide eutectic reinforcing phase embedded in said matrix, the substrate consisting essentially of, by weight, at least an amount in excess of an impurity amount up to 0.02% of boron, 0 to 9% rhenium, 0 to <0.8% titanium, 0 to 20% chromium, 0 to 10% aluminum, 3 to 15% tantalum, 0.1 to 1% carbon, 0 to 20% cobalt, 0 to 20% tungsten, 0 to 7% vanadium, 0 to 10% molybdenum, 0 to 3% columbium, 0 to 3% hafnium, 0 to 1.5% zirconium, the balance nickel and incidental impurities.

8. The article of claim 7 wherein said substrate consists essentially of about, by weight, 0.01% boron, 6.44% rhenium, 3.84% chromium, 5.34% aluminum, 11.37% tantalum, 0.43% carbon, 3.8% cobalt, 4.33% tungsten, 3.01% molybdenum, the balance nickel and incidental impurities.

9. The article of claim 4 wherein said substrate comprises an improved nickel-base superalloy capable of being cast as a single crystal by directional solidification consisting essentially of, by weight, 7 to 12% chromium, 1 to 5% molybdenum, 3 to 5% titanium, 3 to 5% aluminum, 5 to 15% cobalt, 3 to 12% tungsten, 2 to 6% tantalum, up to 10% rhenium, up to 2% columbium, up to 3% vanadium, up to 2% hafnium, the balance nickel and incidental impurities, further characterized by the substantial absence of carbon, boron, and zirconium, the alloy having an Al:Ti ratio in the range of abut 0.5 to about 1 while maintaining the Cr:Al ratio in the range of about 1.5 to 4.

10. The article of claim 9 wherein said substrate consists essentially of, by weight, about 9.3% chromium, 7.5% cobalt, 3.7% aluminum, 4% tantalum, 4.2% titanium, 1.5% molybdenum, 6% aluminum, 0.5% niobium, the balance nickel and incidental impurities.

11. A composite article of manufacture comprising:

(i) a nickel-base superalloy or nickel-base eutectic superalloy substrate, and (ii) one or more thick, built-up regions integral with said substrate, said regions providing at least a portion of the outer surface of said article, said regions having a composition consisting of, by weight, 1 to 10% cobalt, 6 to 12% chromium, 5 to 8% aluminum, 1 to 10% tantalum, 1 to 10% tungsten, 0 to 3% rhenium, 0 to 2% molybdenum, 0.1 to 2% hafnium, 0.005 to 0.1% boron, 0.005 to 0.25% carbon, the balance nickel and incidental impurities.

12. The composite article of claim 11 wherein said regions have a composition consisting essentially of, by weight, 1 to 6% cobalt, 7 to 10% chromium, 5 to 7% aluminum, 4 to 6% tantalum, 3.5 to 5.5% tungsten, 0 to 3% rhenium, 0 to 2% molybdenum, 0.5 to 1.5% hafnium, 0.005 to 0.025% boron, 0.005 to 0.25% carbon, the balance nickel and incidental impurities.

13. The composite article of claim 12 wherein said regions have a composition consisting essentially of, by weight, 3.8 to 4.2% cobalt, 8.3 to 8.7% chromium, 5.8 to 6.2% aluminum, 4.7 to 5.3% tantalum, 4.2 to 4.8% tungsten, 1.2 to 1.8% rhenium, 1.3 to 1.7% molybdenum, 0.7 to 1.1% hafnium, 0.005 to 0.02% boron, 0.005 to 0.2% carbon, the balance nickel and incidental impurities.

14. The article of claim 11 wherein said substrate comprises a composite of a nickel-base superalloy matrix and an aligned fibrous monocarbide eutectic reinforcing phase embedded in said matrix, the substrate consisting essentially of, by weight, at least an amount in excess of an impurity amount up to 0.02% of boron, 0 to 9% rhenium, 0 to <0.8% titanium, 0 to 20% chromium, 0 to 10% aluminum, 3 to 15% tantalum, 0.1 to 1% carbon, 0 to 20% cobalt, 0 to 20% tungsten, 0 to 7% vanadium, 0 to 10% molybdenum, 0 to 3% columbium, <0.15% hafnium, 0 to 1.5% zirconium, the balance essentially nickel and incidental impurities.

15. The article of claim 14 wherein said substrate comprises a composite of a nickel-base superalloy matrix and an aligned fibrous monocarbide eutectic reinforcing phase embedded in said matrix, the substrate consisting essentially of about, by weight, 0.01% boron, 6.44% rhenium, 3.84% chromium, 5.34% aluminum, 11.37% tantalum, 0.43% carbon, 3.8% cobalt, 4.33% tungsten, 3.01% molybdenum, the balance nickel and incidental impurities.

16. The article of claim 11 wherein said substrate comprises an improved nickel-base superalloy capable of being cast as a single crystal by directional solidification consisting essentially of, by weight: 7 to 12% chromium, 1 to 5% molybdenum, 3 to 5% titanium, 3 to 5% aluminum, 5 to 15% cobalt, 3 to 12% tungsten, 2 to 6% tantalum, up to 10% rhenium, up to 2% columbium, up to 3% vanadium, up to 2% hafnium, balance nickel and incidental impurities, and further characterized by the substantial absence of carbon, boron, and zirconium, the alloy having an Al:Ti ratio in the range of about 0.5 to about 1 while maintaining the Cr:Al ration in the range of about 1.5 to 4.

17. The article of claim 16 wherein said substrate comprises an improved nickel-base superalloy capable of being cast as a single crystal by directional solidification consisting essentially of, by weight: about 9.3% chromium, 7.5% cobalt, 3.7% aluminum, 4% tantalum, 4.2% titanium, 1.5% molybdenum, 6% tungsten, 0.5% niobium, the balance nickel and incidental impurities.

18. The claim 11 article wherein said substrate is an aircraft gas turbine engine rotatable blade or stationary vane and said deposit is the tip portion thereof.

* * * * *